United States Patent [19]

Schuhmann

[11] 4,033,259

[45] July 5, 1977

[54] DEVICE FOR ADJUSTING PRINTING PLATES ON THE PLATE CYLINDER OF PRINTING PRESSES

[75] Inventor: Siegfried Schuhmann, Offenbach, Germany

[73] Assignee: Roland Offsetmaschinenfabrik Faber & Schleicher AG, Germany

[22] Filed: June 14, 1976

[21] Appl. No.: 695,421

[30] Foreign Application Priority Data

June 13, 1975 Germany ..... 2526446

[52] U.S. Cl. ..... 101/174; 101/DIG. 12; 33/184.5

[51] Int. Cl.[2] ..... B41F 13/12

[58] Field of Search ..... 101/DIG. 12, 401.3, 101/174, 212; 33/184.5

[56] References Cited

UNITED STATES PATENTS

| | | | |
|---|---|---|---|
| 3,398,633 | 8/1968 | Raivio | 33/184.5 X |
| 3,679,316 | 7/1972 | Boujon | 101/DIG. 12 X |
| 3,969,826 | 7/1976 | Ottenhues et al. | 101/183 |

FOREIGN PATENTS OR APPLICATIONS

| | | | |
|---|---|---|---|
| 1,436,616 | 11/1968 | Germany | 101/DIG. 12 |
| 2,261,084 | 6/1974 | Germany | 101/DIG. 12 |

*Primary Examiner*—J. Reed Fisher

*Attorney, Agent, or Firm*—Leydig, Voit, Osann, Mayer & Holt, Ltd.

[57] ABSTRACT

Apparatus for facilitating peripheral adjustment of a printing plate on a printing cylinder of a multicolor printing press in the form of an optical viewing device having magnifying optics including a single eye piece and two objectives. The objectives are spaced for simultaneous viewing of a peripheral reference mark at the end of the cylinder and an index mark on the plate which is positionally related to the image thereon. The optical viewing device has a screen including an optical reference, with the reference and index marks being superimposable thereon in the same field of view. In one form of the invention a calibrated scale is provided on the screen for direct measurement of the disparity in peripheral register between the two marks. In another form of the invention the bracket which supports the viewing device has an associated calibrated micrometer screw for bodily movement of the viewing device between the two marks and with the change in micrometer reading providing a measure of the amount that the plate must be moved to achieve peripheral register.

6 Claims, 4 Drawing Figures

DEVICE FOR ADJUSTING PRINTING PLATES ON THE PLATE CYLINDER OF PRINTING PRESSES

In multicolor printing in four colors, including black, the separate colors are printed in register with one another using separate printing plates. To achieve exact register it is necessary that each plate be precisely positioned on its plate cylinder. Adjustment of the plates requires a high degree of skill and experience on the part of the pressman, and final adjustment is largely a matter of trail and error involving the making of a succession of test prints.

To increase speed and precision in the adjusting procedure it is known to employ a mangifier for viewing an index mark on the plate. Such an arrangement is shown in Deutsche Offenlegungsschrift No. 2,261,084. In a typical procedure the magnifier is mounted upon a bracket and adjusted in accordance with a reference mark on the plate cylinder. The magnifier is removed for mounting of the printing plate and reinstalled, following which the printing plate is positionally adjusted using the magnifier as a reference. The magnifier is removed during running of the press.

It is an object of the present invention to provide an apparatus and procedure for achieving prompt positional adjustment of a printing plate in a multicolor press. It is a related object to provide means for directly measuring the disparity in peripheral register between the index mark and the reference mark as a criterion for peripheral adjustment of the plate and which permits the plate to be adjusted, prior to running, with such a high order of accuracy so that no final trial and adjustment procedure employing one or more test prints is necessary.

It is another object of the present invention to provide a viewing device for facilitating positional ajustment of a printing plate in which proper adjustment is shown by precise coincidence of reference and index marks on the cylinder and plate respectively. It is a related object to provide apparatus in the form of a viewing device which may be left permanently secured to the press not only during installation and adjustment of the plate but during the press run with the device being constantly available during the course of the run for confirmational viewing and possible touching up of the adjustment.

It is another object to provide viewing apparatus for facilitating adjustment of a printing plate which is universal in usage and highly flexible in operation, including provision for direct measurement of the disparity between index and reference marks on a calibrated scale on a screen included within the device and which makes use of a calibrated micrometer screw associated with the bracket which holds the device for moving the device between the two marks, with the difference in reading of the micrometer screw providing a direct quantitative measure of the disparity between the marks and, accordingly, the amount of movement of the plate which is required to achieve a condition of exact register.

It is a general object to provide viewing apparatus and procedure for facilitating peripheral adjustment of the printing plate to a condition of precise register which is inherently and highly precise and which may be easily and conveniently employed, minimizing set up time and permitting exact registration to be achieved even by a pressman of limited skill and experience.

Other objects and advantages of the invention will be apparent by reading the attached detailed description and upon reference to the drawings in which.

While the invention has been described in connection with certain preferred embodiments, it will be understood that I do not intend to be limited to the particular embodiments shown but intend, on the contrary, to cover the various alternative and equivalent constructions included within the spirit and scope of the appended claims.

Figure 1:
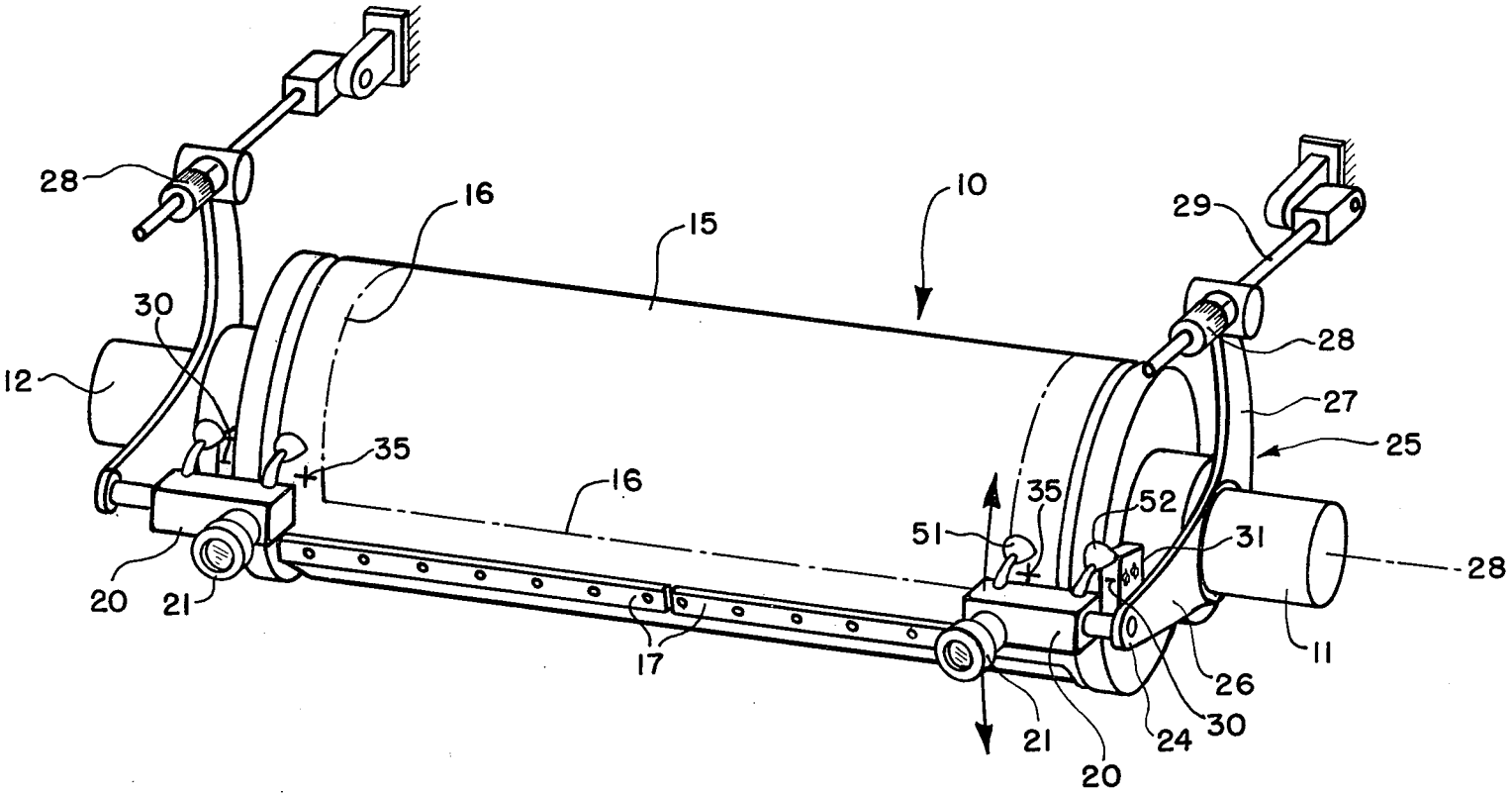
FIG. 1 is a perspective view of a printing cylinder of a typical multicolor offset press, with a plate installed thereon, and showing viewing devices constructed in accordance with the invention at each end of the cylinder.
Figure 2:
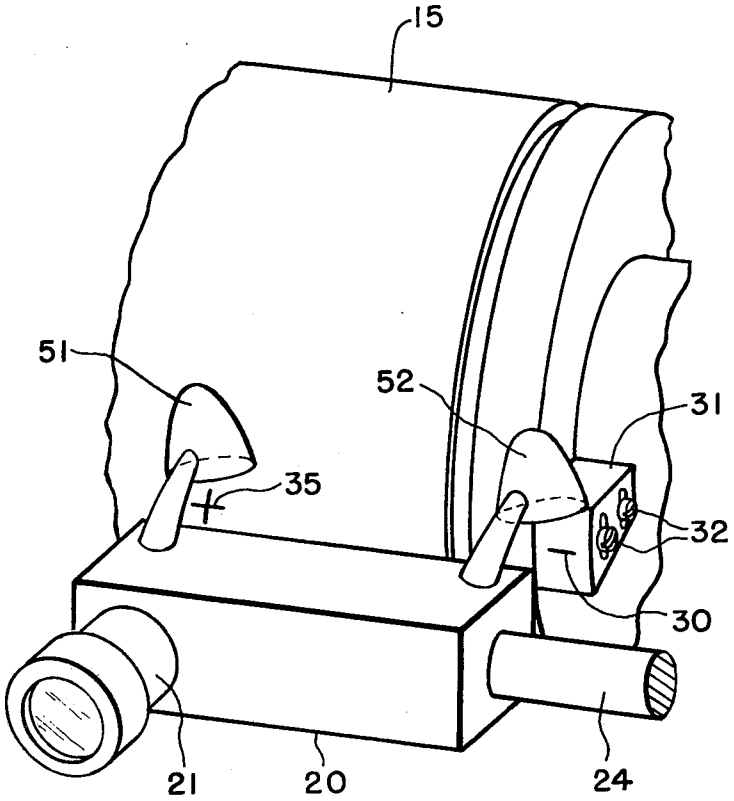
FIG. 2 is a close up perspective showing the device at the right-hand end of the printing cylinder.

Referring to FIGS. 1 and 2 of the drawings there is shown a plate cylinder 10 having journals 11, 12 which are mounted in bearings in the respective side frames of a printing press structure (not shown) which will be understood to include a total of four such plate cylinders for registered printing in four different colors. The cylinder has, stretched around it, a thin flexible printing plate 15 having a printing image thereon, the image being indicated by the dot-dash line 16. A clamping mechanism generally indicated at 17 is provided for holding the end of the plate in place upon the cylinder and for adjusting its position both axially and peripherally. While the details of the clamping mechanism have not been shown, such mechanism may, for example, be of the type illustrated and described in U.S. Pat. No. 3,824,928 issued to Langer on July 23, 1974. It is the purpose of the present invention to provide optical means for measuring the amount by which the plate must be moved on the cylinder to achieve precise register with a point of reference on the cylinder, as well as the direction of required movement, as a criterion for adjustment of the clamping mechanism 17. Assuming that a total of four plate cylinders are used in a typical multicolor press, the cylinders being geared in precise phase synchronism with one another, the accurate registration of each printing plate with respect to its own cylinder insures that all of the printing plates in the press will print in register with one another. Consequently, more detailed attention can be given to the manner in which the position of the plate 15, with respect to the cylinder 10 can be accurately determined.

In accordance with the present invention an optical viewing device having magnifying optics including a single eye piece and two objectives is mounted on the press for simultaneously viewing a peripheral reference mark at the end of the cylinder and an index mark on the plate which is positionally related to the printed image, the optical viewing device having a screen including an optical reference. In one aspect of the present invention the screen includes a calibrated scale for direct read-off of the amount of disparity in peripheral register between the index mark and the reference mark as a criterion for peripherally adjusting the plate. In a second aspect of the invention a calibrated micrometer screw is interposed in the bracket which supports the viewing device, with the amount that the micrometer screw must be moved in shifting the optical reference from the reference mark to the index mark providing the same desired information. In short, the press operator may, either by using the optical scale or by using the micrometer have a direct and immediate indication, in units of distance, of the amount, and direction, that the plates must be shifted to achieve exact register with the cooperating plates in the press.

Figure 3:
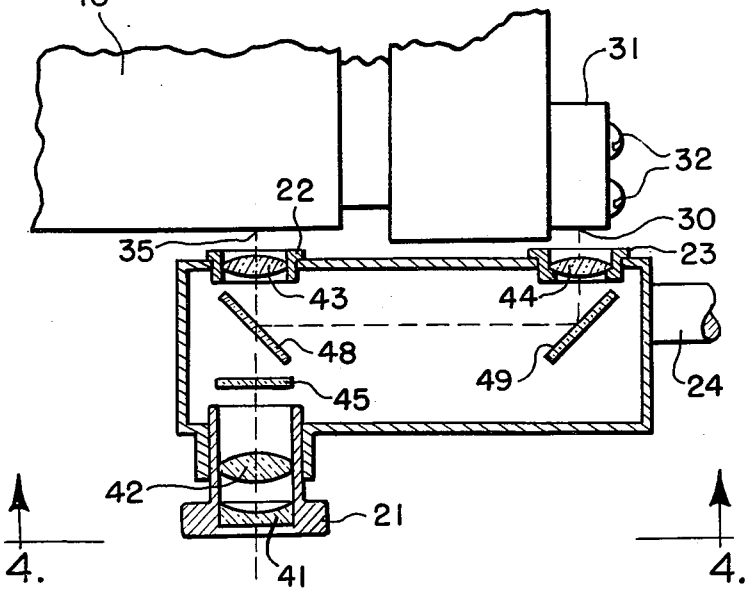
FIG. 3 is a diagrammatic horizontal section taken through the viewing device and illustrating the optics employed in carrying out the invention.

Restricting attention to the right-hand one of the devices illustrated in FIG. 1, the optical viewing device 20 has a single eye piece 21 and two objectives 22, 23 (see also FIG. 3). The device 20 has a mount 24 for securing it to a bracket in the form of a lever 25 having a first arm 26 and a second arm 27. The second arm is connected, via a micrometer screw assembly 28, to a link 31 in the form of a rod which is pinned to press frame structure. By fulcruming the lever 25 about the cylinder axis 28 and by making the arms 26, 27 of the lever of the same length, displacement measured at the micrometer screw corresponds exactly to the displacement, peripherally, of the viewing device 20 about the surface of the cylinder.

For the purpose of establishing a point of reference on the cylinder itself, a reference mark 30 is inscribed upon a reference block 31 which is adjustably secured by screws 32 and which is located, in peripheral position, at the adjacent end of the cylinder. Inscribed on the plate itself in a position which is accurately related to the printed image 16 on the plate, is an index mark 35. Such index mark, which is preferably in the form of a cross, is arranged near the edge of the plate at a spacing from the reference mark 30 which substantially corresponds to the spacing between the viewing objectives 22, 23. As a result the marks 30, 35 are simultaneously viewable, being optically superimposed in the same field of view.

Figure 4:
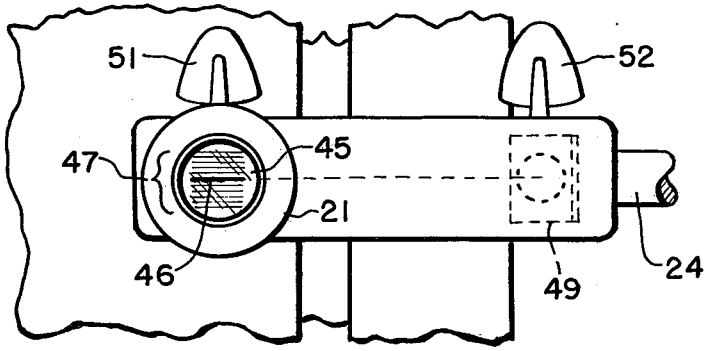
FIG. 4 shows the viewing device in elevation, as seen along line 4—4 of FIG. 3, including the appearance of the translucent screen with its optical reference line.

The invention is not limited to any particular optical means for magnifying, and superimposing, the reference and image marks relative to an optical reference. However, a typical simplified optical arrangement is diagrammatically illustrated in FIG. 3. As here shown, the eye piece 21 includes a pair of lenses 41, 42 which cooperate with an objective lens 43. Placed at the focal plane of the lenses 41, 42 is a translucent screen 45 (see also FIG. 4). Such translucent screen includes an optical reference line 46 with an associated calibrated scale 47, the scale being expanded in accordance with the degree of mangification of the field. A second objective lens 44 is used in objective 23.

For the purpose of superimposing the image of the reference mark 30 upon the image of the index mark 35, an image combining device in the form of a half-silvered mirror 48 is provided in line with the eye piece, the mirror 48 being arranged at 45° and parallel to a second mirror 49 alined with the first objective 22. The marks are brightly illuminated by respective concentrated light sources 51, 52.

Consequently, the pressman, in looking through eye piece 21 views the translucent screen 45, seeing, superimposed upon the screen, the images of the reference mark 30 and index mark 35 which will, at least initially, be displaced from one another and either upwardly or downwardly from the optical reference line 46 on the screen.

In use the plate cylinder is stopped with the reference mark 30 within the field of view of the objective 22. The "old" plate is removed and the "new" plate, bearing the index mark 35 is installed on the cylinder in the usual way and in a position of approximate register. With the marks 30, 35 illuminated, the images thereof will be superimposed upon the scale 47 in the viewing device, the two marks being distinguished by the fact that the reference mark is in the form of a horizontal line and the index mark is in the form of a cross. To measure the disparity in peripheral register, the number of divisions between the two marks on the scale may be counted and the relative positions of the marks may be noted. This provides a criterion for the amount and direction of the adjustment of the plate clamping means to bring about a condition of precise register. The condition of register may be confirmed by noting whether the two marks have been superimposed upon one another in the field of view.

To facilitate reading the scale 47 it is convenient, as an initial step, to rotate the micrometer screw until one of the marks falls upon the optical reference line 46, so that the graduations may be counted from the reference line 46 as a base.

If desired, the graduations of the scale 47 may be disregarded and the disparity between the marks may be directly measured by using the calibrated micrometer screw 28. In this mode of usage, the screw 28 is initially turned, moving the viewing device bodily about the periphery of the cylinder, accompanied by relative shifting of the images of the reference and index marks in the field of view. The micrometer screw is turned until one of the marks, for example the reference mark 30, coincides with the optical reference line 46. The calibrations of the micrometer screw are then read to provide a base, or reference, figure. The micrometer screw is then turned in a direction to shift the mark images until the second mark, for example the index mark 35, coincides with the optical reference line. The calibrated micrometer screw is then read a second time, with the subtraction of one of the readings from the other being a direct measure of the displacement of the viewing device and thus a direct measure of the peripheral disparity between the marks 30, 35, providing a criterion for adjustment of the plate.

When the apparatus is used in the "micrometer screw" mode, the operation may be simplified by originally setting the micrometer screw to its zero setting and by using an auxiliary screw, in series with the micrometer screw, to bring about the initial coincidence between one of the mark images and the optical reference. Thus when the micrometer screw is turned to bring the other mark into coincidence with the optical reference, the reading of the micrometer gives the disparity directly without necessity for subtraction.

While the invention has been described in connection with the apparatus at the right-hand end of the printing cylinder illustrated in FIG. 1, it will be understood that identical apparatus, in mirror image, is employed at the other end of the cylinder, corresponding elements being indicated by corresponding reference numerals with additions of subscript *a*. Repeating the register measurement and adjustment at each end of the cylinder automatically precludes any misregister in "skew."

Although the optical details and optical parameters have not been spelled out, the above discussion provides an adequate basis for the working out of such details, in practical form, by an optical engineer without exercise of more than the normal skill of the art.

It will be apparent that the above apparatus and procedure amply fulfills the objects set forth above. With each plate accurately registered on its cylinder, and with all of the cylinders being coupled together in accurate phase, precise register is assured before the press begsins to turn. The viewing devices are, at all times, left in place so that the condition of register may be optically confirmed at any time. Moreover, leaving the apparatus in place makes it unnecessary for the pressman to mount and unmount the unit thereby reducing the chances of misadjustment, loss, or damage. In the past, without magnified optical assistance, it has been necessary for the pressman to "guess at" the amount of shift of the plate required to bring about accurate register. Use of the present device, with its alternatively employed calibrated scales, reduces any guesswork and makes unnecessary the practice of trial and error so that precise initial register may be achieved even by a pressman of limited skill and experience. The problem of registeringly shifting the plate is further simplified using plate clamping devices in which the registering adjustments are calibrated in the same units of length used in the scale of a micrometer screw or used in the scale on the translucent screen of the viewing device.

It is one of the features of the present construction that it lends itself to remote display using existing types of optical-electronic transmitters and receivers. As a simple means of achieving remote display over short distances, fibre optics may be used for transmitting the total image upon the translucent viewing screen 45, for example, to a viewing screen in a convenient position for the pressman as he turns the register adjusting screws on the cylinder.

In referring to the optical reference line 46 on the screen as being centered in the field of view, it is meant that such line occupies a conveniently viewable position within the field of view. The term "screen" is a general term for means carrying an optical reference fixed in the viewing device and permitting simultaneous viewing of the reference and index marks with respect thereto.

What I claim is:

1. Apparatus for facilitating peripheral adjustment of a printing plate on a printing cylinder of a multi-color press comprising, in combination, a frame, means for journaling the cylinder in the frame, means fixed at the end of the cylinder for carrying a peripheral reference mark, an index mark on the plate positionally related to the image thereon and in a position on the plate which is adjacent the reference mark on the cylinder, an optical viewing device having magnifying optics including a single eye piece and two objectives, the objectives being spaced for simultaneous viewing of the reference mark and index mark superimposed in the same field of view, the optical viewing device having a screen including an optical reference generally centered in the field of view, means including a bracket secured to the frame for permanently supporting the optical viewing device on the press in a viewing position, means including a threaded adjusting element interposed in the bracket between the frame and the viewing device for adjusting the peripheral position of the viewing device about the cylinder thereby to bring the reference mark and index mark within the field of view of the viewing device, and means including a scale associated with the viewing device for measuring the disparity in peripheral register between the index mark and the reference mark as a criterion for peripheral adjustment of the plate into a condition of peripheral register.

2. Means for facilitating peripheral adjustment of a printing plate on a printing cylinder of a multicolor press comprising, in combination, means fixed at the end of a cylinder for carrying a peripheral reference mark, an index on the plate positionally related to the image thereon and in a position on the plate which is adjacent the reference mark on the cylinder, an optical viewing device having magnifying optics including a single eye piece and two objectives, the objectives being spaced for simultaneous viewing of the reference mark and index mark superimposed in the same field of view, the optical viewing device having a screen including an optical reference centered in the field of view, a bracket for permanently supporting the optical device on the press in a viewing position, and means including a calibrated micrometer screw interposed in the bracket for moving the optical viewing device peripherally between the reference mark and index mark with the change in the micrometer reading providing a measure of the amount that plate must be moved to achieve peripheral register.

3. The combination as claimed in claim 2 in which the bracket is adjustably swingable about the axis of the printing cylinder.

4. The combination as claimed in claim 2 in which the bracket is in the form of an arm swingable about the cylinder axis at one end and carrying the optical viewing device at the other end, a micrometer screw being interposed between the arm and the frame of the press.

5. Means for facilitating peripheral adjustment of a printing plate on a printing cylinder of a multicolor press comprising, in combination, means fixed at the ends of the cylinder for carrying respective peripheral reference marks, index marks on the plate positionally related to the image thereon and in positions on the plate which are respectively adjacent the reference marks on the cylinder, first and second optical viewing devices each having magnifying optics including a single eye piece and two objectives, the objectives being spaced for simultaneous viewing of a reference mark and the associated index mark superimposed in the same field of view, each optical viewing device having a screen including an optical reference centered in the field of view, brackets for respectively supporting the optical viewing devices on the press in viewing positions, and means including respective micrometer screws interposed in the brackets for moving the viewing devices with respect to the reference and index marks, with the amount of movement being directly indicative of the amount the plate move to achieve a condition of peripheral register.

6. Means for facilitating peripheral adjustment of a printing plate on a printing cylinder of a multi-color press comprising, in combination, a frame, means for journaling the cylinder in the frame, means fixed at the end of the cylinder for carrying a peripheral reference mark, an index mark on the plate positionally related to the image thereon and in a position on the plate which is adjacent the reference mark on the cylinder, an optical viewing device having a single eye piece and two objectives, the objectives being spaced for simultaneous viewing of the field of the reference mark and index mark superimposed in the same field of view, the optical viewing device having a screen including an optical reference and calibrated scale, the optical viewing device including mangification for mangifying the field with the scale being expanded in proportion thereto, a bracket on the frame for permanently supporting the optical viewing device on the press in a viewing position, the bracket having associated manually operated position adjusting means interposed in the bracket between the frame and the viewing device, the adjusting means being oriented to effect limited peripheral swinging movement of the viewing device about the cylinder for thereby permitting visual alinement of the optical reference with the reference mark thereby permitting the relative position of the index mark to be read out directly from the scale as a criterion for peripheral adjustment of the plate into a condition of peripheral register.

* * * * *